US006157358A

United States Patent [19]

Nakajima et al.

[11] Patent Number: 6,157,358

[45] Date of Patent: Dec. 5, 2000

[54] LIQUID CRYSTAL DISPLAY

[75] Inventors: Yoshiharu Nakajima; Toshikazu Maekawa, both of Kanagawa, Japan

[73] Assignee: Sony Corporation, Tokyo, Japan

[21] Appl. No.: 09/141,323

[22] Filed: Aug. 27, 1998

[30] Foreign Application Priority Data

Aug. 19, 1997 [JP] Japan ..... 9-233518

[51] Int. Cl.[7] ..... G09G 3/36; G09G 5/00

[52] U.S. Cl. ..... 345/96; 345/209; 345/98

[58] Field of Search ..... 345/96, 209, 87–104

[56] References Cited

U.S. PATENT DOCUMENTS

| | | | |
|---|---|---|---|
| 5,168,270 | 12/1992 | Maumori et al. | 345/100 |
| 5,196,738 | 3/1993 | Takahara et al. | 345/89 |
| 5,266,936 | 11/1993 | Saitoh | 345/98 |
| 5,640,174 | 6/1997 | Kamei et al. | 345/89 |
| 5,686,936 | 11/1997 | Maekawa et al. | 345/94 |
| 5,907,314 | 5/1999 | Negishi et al. | 345/100 |
| 5,973,660 | 10/1999 | Hashimoto | 345/204 |
| 5,995,072 | 11/1999 | Nakajima | 345/87 |
| 6,008,801 | 12/1999 | Jeong | 345/204 |
| 6,069,605 | 5/2000 | Ozawa | 345/100 |

FOREIGN PATENT DOCUMENTS 44 46 330 A1 7/1995 Germany .

08305323 11/1996 Japan .

OTHER PUBLICATIONS

Tsuchi H Et Al: "17.2: A New Digital Data–Line Circuit for TFT–LCD Driving" SID International Symposium, US, Santa Ana, SID, vol. 27, pp. 251–254 XP000621040 ISSN: 0097–966X *p. 252, left–hand column—right–hand column, line 2; figure 1*.

*Primary Examiner*—Mark R. Powell
*Assistant Examiner*—Anthony J Blackman
*Attorney, Agent, or Firm*—Ronald P. Kananen; Rader, Fishman & Grauer

[57] ABSTRACT

Since each driving circuit has corresponded to the entire range of signal voltage, the dynamic range is large, it is difficult to constitute it by high Vth transistors, and a circuit having sufficient driving capacity for both input and output of current must be used, leading to increased circuit area and current consumption. To solve the problem, a circuit for driving column lines is divided into two in response to signal voltage with, for example, the common voltage as a reference, and these two column line driving circuits are arranged on the upper and lower sides of the LCD effective screen portion every two columns, and when the output end of the one column line driving circuit is connected to one of two column lines the analog switches are open-close timing controlled so that the output end of the other column line driving circuit is connected to the other of the two column lines.

16 Claims, 4 Drawing Sheets

LIQUID CRYSTAL DISPLAY

BACKGROUND OF THE INVENTION

1. Field of the Invention

The present invention relates to a driving circuit for a liquid crystal display (hereinafter, referred to as LCD), and more particularly to a column line driving circuit for an active matrix LCD.

2. Description of Related Art

FIG. 4 shows an example of the structure of the active matrix LCD. In FIG. 4, a LCD panel 102 is constituted by two-dimensionally arranging liquid crystal cells (pixels) 101 in a matrix shape. On the periphery of this LCD panel 102, there are provided a vertical driver 103 for selecting rows, and a horizontal driver (hereinafter, referred to as column line driving circuit) 104 for selecting columns. As regards the column line driving circuit 104, it has heretofore been arranged only on the upper side of the LCD panel 102 as shown in the same figure, or the same one each is arranged on both the upper and lower sides thereof, and each driving circuit has been adapted to correspond to the entire range of signal voltage applied to the LCD.

In the conventional column line driving circuit constructed as described above, however, since each driving circuit is to cover a minimum level to a maximum level of signal voltage, the dynamic range is large.

In order to produce a column line driving circuit with such a large dynamic range, transistors with low threshold voltage Vth must be used, and it is difficult to constitute the column line driving circuit by transistors with such high threshold voltage Vth as a polysilicon TFT (Thin Film Transistor). Moreover, since the number of circuit elements is great, it is very difficult to realize using such an element with a large variation in characteristics as polysilicon TFT. Also, even in case where it is produced using monocrystal silicon, a circuit (for example, push-pull circuit) having sufficient driving ability must be used for both input and output of current, and therefore, both circuit area and current consumption will be increased.

SUMMARY OF THE INVENTION

The present invention has been achieved in the light of the above-described problems, and is aimed to provide a LCD driving circuit in which it is easy to produce a circuit using transistors with high threshold voltage Vth, and capable of reducing the circuit area and power consumption.

A LCD driving circuit according to the present invention comprises a first column line driving circuit, arranged for every two column lines on one of the upper and lower sides of a LCD effective screen portion, for driving the column line for a larger signal than predetermined reference voltage; a second column line driving circuit, arranged for every two column lines on the other of the upper and lower sides of the LCD effective screen portion, for driving the column line for a smaller signal than the predetermined reference voltage; a first pair of analog switches connected between the output end of the first column line driving circuit and the two column lines; a second pair of analog switches connected between the output end of the second column line driving circuit and the two column lines; and a control circuit for open-close controlling the first and second pair of analog switches respectively so that when the output end of the first column line driving circuit is connected to one of the two column lines, the output end of the second column line driving circuit is connected to the other of the two column lines.

In the LCD driving circuit constructed as described above, when the output end of the first column line driving circuit for a larger signal voltage than predetermined reference voltage (for example, common voltage) is connected to one of the two column lines, the first and second pair of analog switches are open-close timing controlled so that the output end of the second column line driving circuit for smaller signal voltage is connected to the other of the two column lines, whereby the first column line driving circuit operates as a sweep-off driving circuit, and the second column line driving circuit operates as a lead-in driving circuit. As a result, the output buffer for the first or second column line driving circuit can be constituted by only a circuit (for example, source follower circuit) excellent only in current driving in one side direction.

DESCRIPTION OF THE PREFERRED EMBODIMENTS

Hereinafter, with reference to the drawings, the detailed description will be made of embodiments of the present invention.

Figure 1:
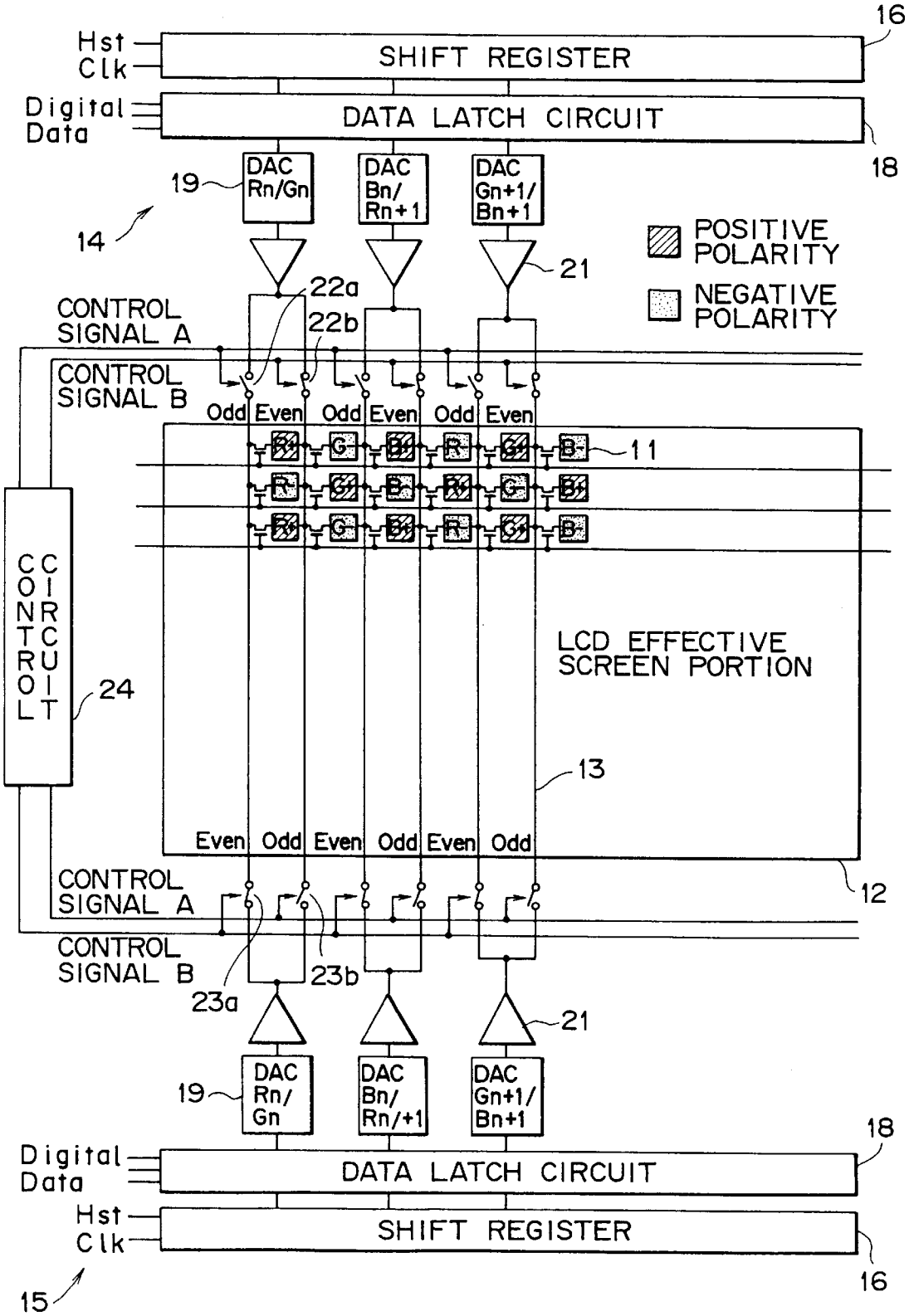
FIG. 1 is a schematic structural view showing a first embodiment according to the present invention.

FIG. 1 is a schematic structural view showing a first embodiment according to the present invention. In FIG. 1, a LCD effective screen portion 12 is constituted by two-dimensionally arranging liquid crystal cells (pixels)11 in a matrix shape. Above each liquid crystal cell 11, there are arranged striped color filters (not shown) of R (Red), G (Green) and B (Blue) A circuit for driving column lines 13 is divided into two in response to signal voltage, for example, with common voltage applied to the common electrode of the liquid crystal as a reference.

More specifically, the circuit is divided into a first column line driving circuit 14 corresponding to higher signal voltage than the common voltage, and a second column line driving circuit 15 corresponding to lower signal voltage than the common voltage. For example, the first column line driving circuit 14 is arranged on the upper side of the LCD effective screen portion 12, and the second column line driving circuit 15 is arranged on the lower side of the LCD effective screen portion 12 in such a manner that they operate in parallel.

Figure 2:
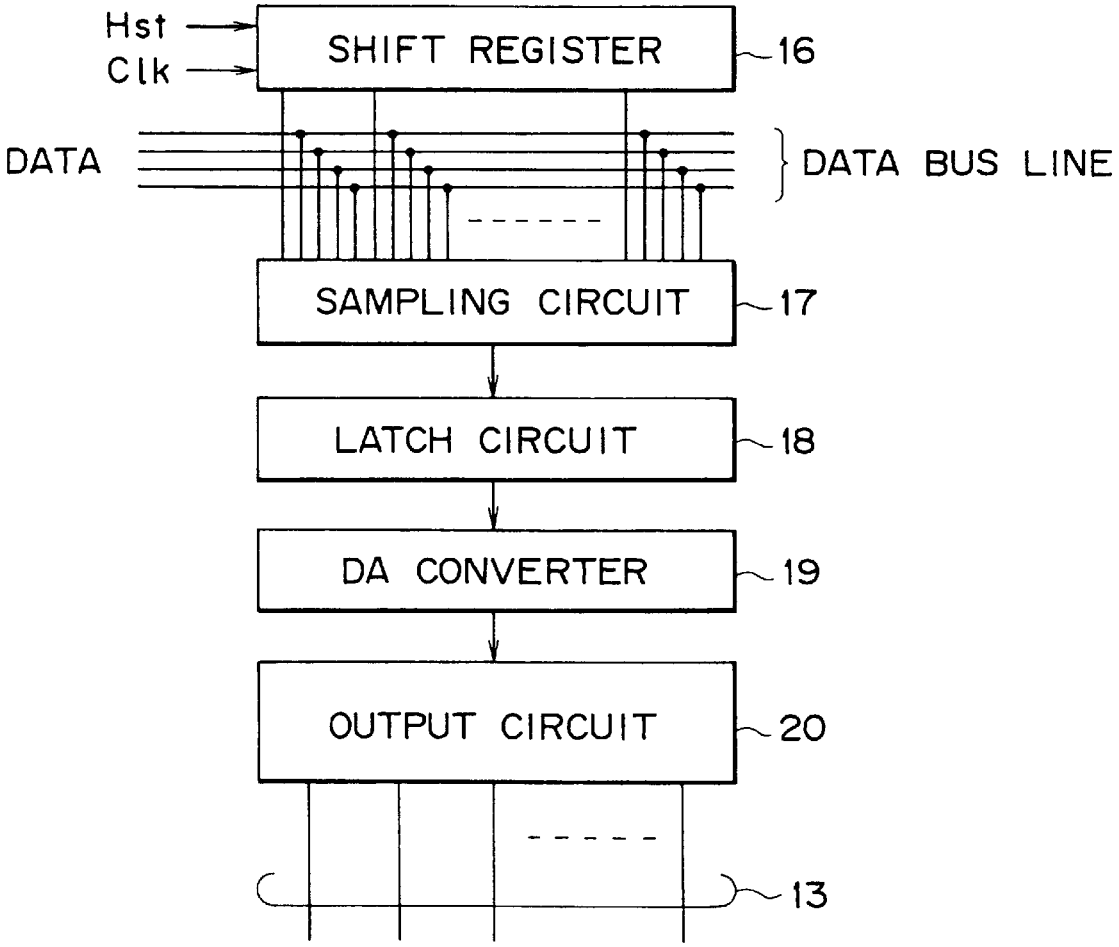
FIG. 2 is a block diagram showing an example of the structure of a column line driving circuit.

The first or second column line driving circuit 14 or 15 comprises, as shown in FIG. 2, a shift register 16 for outputting sampling pulses in order, a sampling circuit 17 for sampling the data on a data bus line in synchronization with sampling pulses given from this shift register 16 in order, a latch circuit 18 for retaining these sampling data during one horizontal period, a DA converter 19 for converting the latch data into an analog signal, and an output circuit 20 for driving a load on the column line (signal conductor) 13.

One each of the DA converter 19 and the output circuit 20 for the first or second column line driving circuit 14 or 15 are arranged for every two columns. More specifically, as can be seen from FIG. 1, each output buffer 21 constituting the output circuit 20 is arranged for two column lines 13 and 13 which are adjacent each other. The DA converters 19 are also arranged by a number corresponding to the number of the output buffers 21.

There are connected a pair of analog switches 22*a*, 22*b* between the output end of the output buffer 21 on the side of the first column line driving circuit 14 and two column lines 13, 13 which are adjacent to each other. Likewise, there are connected a pair of analog switches 23*a*, 23*b* between the output end of the output buffer 21 on the side of the second column line driving circuit 15 and these two column lines 13, 13. The pair of analog switches 22*a*, 22*b* are open-close timing controlled through control signals A, B outputted from a control circuit 24, and likewise, the pair of analog switches 23*a*, 23*b* are also open-close timing controlled through control signals B, A.

Concretely, when the output end of the output buffer 21 of the first column line driving circuit 14 is connected to the column line 13 at an odd step, timing is controlled so that the output end of the output buffer 21 of the second column line driving circuit 15 is connected to the column line 13 at an even step. Conversely, when the output end of the output buffer 21 of the second column line driving circuit 15 is connected to the column line 13 at an odd step, timing is controlled so that the output end of the output buffer 21 of the first column line driving circuit 14 is connected to the column line 13 at an even step.

When electric charge is given to the column line 13*n* at a n-th step using the first column line driving circuit 14 under this timing control, the electric charge on the column line 13*n*+1 at a (n+1) th step can be discharged using the second column line driving circuit 15, and when electric charge is given to the column line 13*n*+1 at a (n+1)th step using the first column line driving circuit 14 at another timing, the electric charge on the column line 13*n* at a n-th step can be discharged using the second column line driving circuit 15. In other words, the first column line driving circuit 14 operates as a sweep-off driving circuit, while the second column line driving circuit 15 operates as a lead-in driving circuit.

The connection of the output end of the output buffer 21 of the first column line driving circuit 14 to the column line at the odd step or at the even step, and the connection of the output end of the output buffer 21 of the second column line driving circuit 15 to the column line 13 at the even step or at the odd step, are switched for each horizontal period respectively, whereby dot reverse driving can be performed. Here, the dot reverse means a state in which pixels adjacent to each other in the two-dimensional array of liquid crystal cells (pixels) 11 alternately become positive or negative in polarity as shown in FIG. 1.

As described above, a circuit for driving the column lines 13 is divided into two in response to signal voltage with, for example, the common voltage as a reference, and one each of these two column line driving circuits 14, 15 are arranged for every two column lines on the upper and lower sides of the LCD effective screen portion 12, and when the output end of the one column line driving circuit 14 is connected to one of these two column lines, the analog switches 22*a*, 22*b* and 23*a*, 23*b* are open-close timing controlled so that the output end of the other column line driving circuit 15 is connected to the other of the two column lines, whereby the dot reverse driving can be easily performed, and yet the area efficiency is good because there are few circuits at rest.

The output buffer 21 can be constituted only by a circuit in which it is limited to sweep- off or lead-in of current, that is, a circuit (for example, source follower circuit) excellent only in current driving in one side direction. This provides the following effects:

(1) Even in case where such high Vth transistors as polysilicon TFT are used, a system in which the output dynamic range has been sufficiently secured can be easily constructed. As a result, it becomes useful particularly when a driving circuit is integrally formed on a polysilicon LCD.

(2) Since the circuit can be constituted by a minimum quantity of elements, an output buffer 21, which is less affected by variation in transistor can be constituted.

(3) Since the DA converter 19 and the output buffer 21 can be operated within a limited voltage range, it is possible to simplify the circuit configuration and to reduce the circuit area.

(4) Since the output buffer 21 can be constituted by minimum DC current, it is possible to reduce the power consumption.

Further, when in the first and second column line driving circuits 14, 15, a reference voltage selection type DA converter is used as the DA converter 19, the following effects can be obtained:

(1) The area can be reduced because a reference voltage line can be set only to voltage within a range covered by the column line driving circuit 14, 15.

(2) A switch used as a reference voltage selector can be constituted only by a NMOS transistor or a PMOS transistor, to thereby make it possible to reduce the area.

In this respect, in the above-described embodiment, the description has been made of the case in which the first column line driving circuit 14 for corresponding to a higher signal voltage than the common voltage is arranged on the upper side of the LCD effective screen portion 12, and in which the second column line driving circuit 15 for corresponding to a lower signal voltage than the common voltage is arranged on the lower side of the LCD effective screen portion 12, but the arrangement may be reversed as a matter of course.

Also, in the above-described embodiment, the predetermined reference voltage for dividing the first and second column line driving circuits 14, 15 has been set to the common voltage applied to the common electrode of a liquid crystal, but the voltage which is made as the reference for division is not limited to the common voltage but any voltage near signal center voltage may be used.

Further, in the above-described embodiment, the connection of the output end of the output buffer 21 of the first column line driving circuit 14 to the column line 13*o* or 13*e*, and the connection of the output end of the output buffer 21 of the second column line driving circuit 15 to the column line 13*e* or 13*o*, have been switched for each horizontal period respectively, but the connection may be switched for each field.

Figure 3:
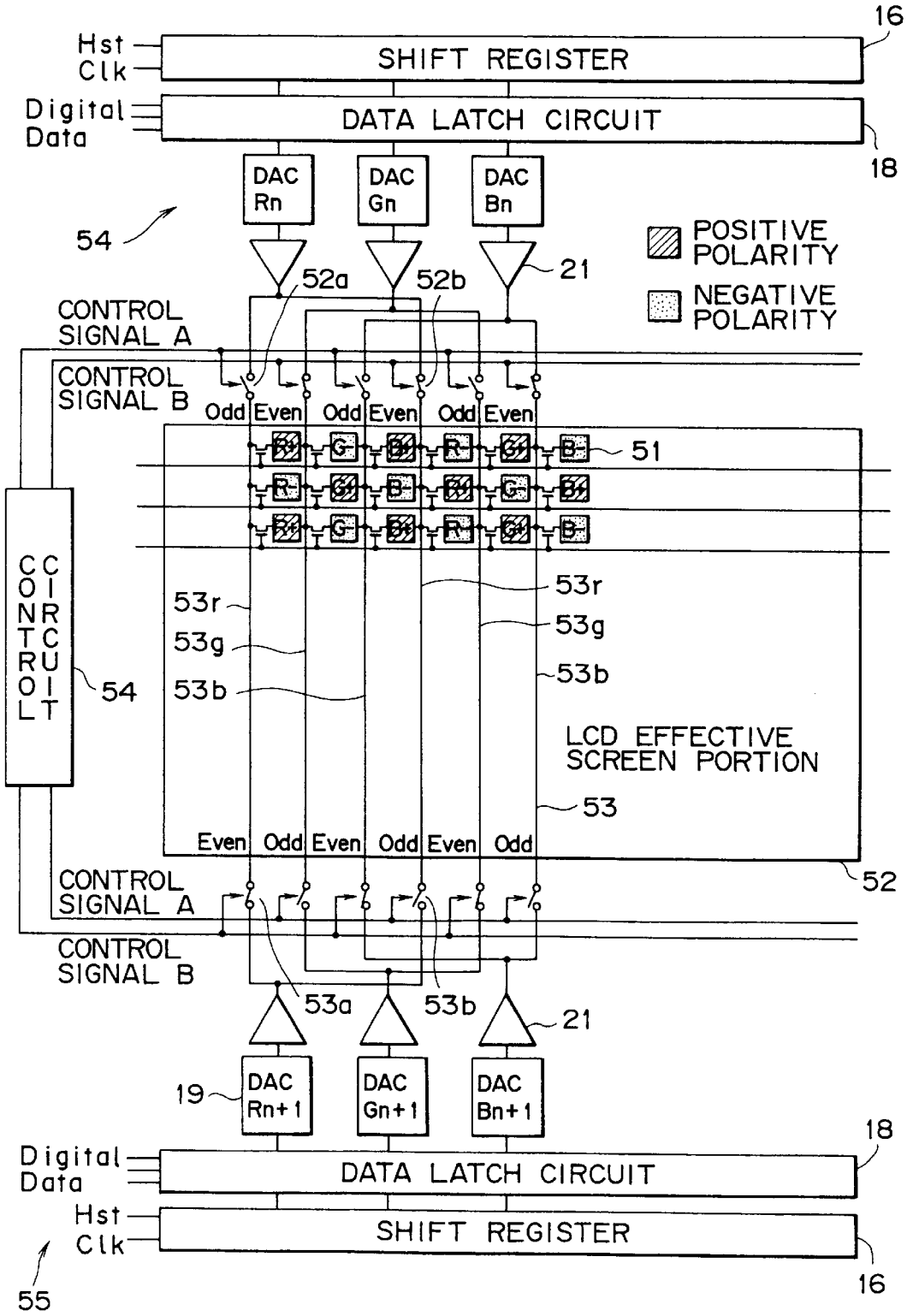
FIG. 3 is a schematic structural view showing a second embodiment according to the present invention.
Figure 4:
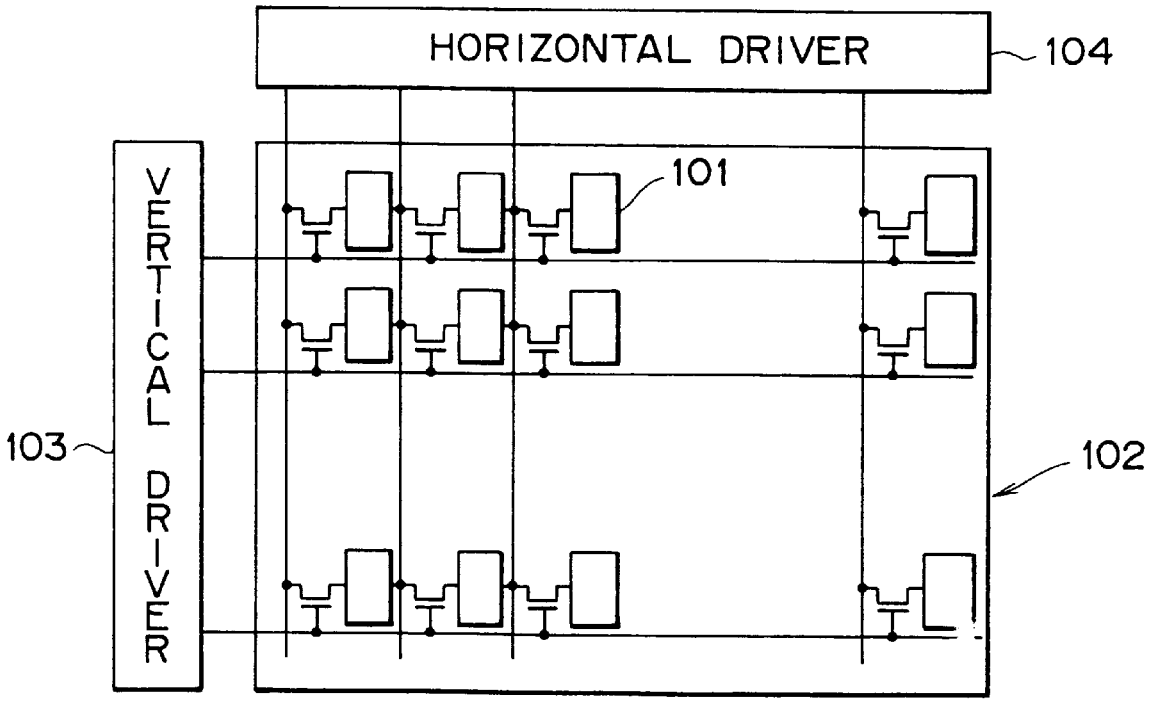
FIG. 4 is a schematic structural view showing an example of an active matrix LCD.

FIG. 3 is a schematic structural view showing a second embodiment according to the present invention. In FIG. 3, on the upper side of a LCD effective screen portion 52 comprising liquid crystal cells (pixels) 51 two-dimensionally arranged in a matrix shape, a first column line driving circuit 54 for corresponding to higher signal voltage than the common voltage is arranged, and on the lower side of the LCD effective screen portion 52, a second column line driving circuit 55 for corresponding to lower signal voltage than the common voltage is arranged, and the DA converters and output circuits for the first and second column line driving circuits 14, 15 are arranged for every two column lines respectively in such a manner that they operate in parallel as in the case of the first embodiment.

In the above-described structure, as the first or second column line driving circuit 54 or 55, a circuit having the circuit configuration shown in , for example, FIG. 2 is used. A DA converter 19 and an output buffer 21 for the first or second column line driving circuit 54 or 55 are arranged for every two adjacent columns of the same color respectively. More specifically, as can be seen from FIG. 3, one each of output buffer 21 is arranged for two adjacent column lines 53 and 53 of the same color. The DA converters 19 are also arranged by a number corresponding to the number of the output buffers 21.

Between the output end of the output buffer 21 on the side of the first column line driving circuit 54, and two column lines 53*r*, 53*r* of, for example, R color which are adjacent to each other, there are connected a pair of analog switches 52*a*, 52*b*. Likewise, between the output end of the output buffer 21 on the side of the second column line driving circuit 55 and those two column lines 53*r*, 53*r*, there are connected a pair of analog switches 53*a*, 53*b*. As regards G color and B color, a pair of analog switches 52*a*, 52*b*, and 53*a*, 53*b* are connected in quite the same manner as in the case of R color.

The pair of analog switches 52*a*, 52*b* are open-close timing controlled through control signal A, B outputted from a control circuit 54, and likewise, the pair of analog switches 53*a*, 53*b* are also open-close timing controlled through control signal B, A. Concretely, as regards R color, when the output end of the output buffer 21 of the first column line driving circuit 54 is connected to the column line 53*r* at an odd step, timing control is made so that the output end of the output buffer 21 of the second column line driving circuit 55 is connected to the column line 53*r* at an even step.

Conversely, when the output end of the output buffer 21 of the second column line driving circuit 55 is connected to the column line 53*r* at an odd step, timing control is made so that the output end of the output buffer 21 of the first column line driving circuit 54 is connected to the column line 53*r* at an even step. As regards C color and B color, the same timing control as in the case of R color is performed.

As described above, a circuit for driving the column line 53 is divided into two in response to signal voltage with, for example, the common voltage as a reference, and these two column line driving circuits 54, 55 are arranged on the upper and lower sides of the LCD effective screen portion 52 every two column lines, and when the output end of the one column line driving circuit 54 is connected to one of the two column lines, the analog switches 52*a*, 52*b* and 53*a*, 53*b* are open-close timing controlled so that the output end of the other column line driving circuit 55 is connected to the other of the two column lines, whereby the same operative effect as in the case of the first embodiment can be obtained.

In addition to the foregoing, this embodiment is arranged such that the column lines, to which the output circuit 20 of the first or second column line driving circuit 54, 55 is connected, are not two adjacent columns, but two adjacent columns of the same color in such a manner that switching between the column lines of the same color is performed, and therefore, there is an advantage that there is no need for switching between data signals for different colors.

In this respect, the output circuit of each column line driving circuit has been connected to the two adjacent columns in the first embodiment, and to the two adjacent columns of the same color in the second embodiment, but the present invention is not limited to these columns, but two any adjacent columns may be used so long as the control signals A, B for a pair of analog switches arranged on the upper and lower sides of the column lines are different from each other in polarity.

As described above, the present invention is constructed such that a circuit for driving column lines is divided into two in response to signal voltage, and these two column line driving circuits are arranged on the upper and lower sides of the LCD effective screen portion every two columns, and that when the output end of the one column line driving circuit is connected to one of those two column lines, timing control is performed so that the output end of he other column line driving circuit is connected to the other of the two column lines, whereby the output buffer can be operated within a limited voltage range, and yet the output buffer can be constituted by only a circuit excellent only in current driving in one side direction. Therefore, it becomes easy to form a circuit using high Vth transistors, and it is possible to reduce the circuit area and the power consumption.

What is claimed is:

1. A liquid crystal display comprising:

a first column line driving circuit, arranged for every two column lines, for driving the column line for a larger signal than a predetermined reference voltage;

a second column line driving circuit, arranged for every two column lines, for driving the column line for a smaller signal than said predetermined reference voltage;

a first pair of analog switches connected between the output end of said first column line driving circuit and the two column lines;

a second pair of analog switches connected between the output end of said second column line driving circuit and the two column lines; and a control circuit for open-close controlling said first and second pair of analog switches respectively so that when the output end of said first column line driving circuit is connected to one of the two column lines, the output end of said second column line driving circuit is connected to the other of the two column lines.

2. A liquid crystal display as claimed in claim 1, wherein said predetermined reference voltage is common voltage to be applied to the common electrode of a liquid crystal, or any voltage in the vicinity of signal center voltage.

3. A liquid crystal display as claimed in claim 1, wherein said two column lines are two column lines which are adjacent to each other.

4. A liquid crystal display as claimed in claim 1, wherein said two column lines are two column lines of the same color which are adjacent to each other.

5. A liquid crystal display as claimed in claim 1, wherein the connection of said control circuit to the column line at the output end of said first or second column line driving circuit is switched for each horizontal period or for each field period.

6. A liquid crystal display as claimed in claim 1, wherein said first and second column line driving circuits comprise source follower circuits.

7. A liquid crystal display as claimed in claim 1, wherein said first column line driving circuit is for discharging and said second column line driving circuit is for charging.

8. A liquid crystal display as claimed in claim 1, wherein said liquid crystal display is dot-inversion driven.

9. A liquid crystal display comprising:

a first column line driving circuit, arranged for every two column lines on one of the upper and lower sides of an effective screen portion, for driving the column line for a larger signal than a predetermined reference voltage;

a second column line driving circuit, arranged for every two column lines on the other of the upper and lower sides of said effective screen portion, for driving the column line for a smaller signal than said predetermined reference voltage;

a first pair of analog switches connected between the output end of said first column line driving circuit and the two column lines;

a second pair of analog switches connected between the output end of said second column line driving circuit and the two column lines; and a control circuit for open-close controlling said first and second pair of analog switches respectively so that when the output end of said first column line driving circuit is connected to one of the two column lines, the output end of said second column line driving circuit is connected to the other of the two column lines.

10. A liquid crystal display as claimed in claim 9, wherein s aid predetermined reference voltage is common voltage to be applied to the common electrode of a liquid crystal, or any voltage in the vicinity of signal center voltage.

11. A liquid crystal display as claimed in claim 9, wherein said two column lines are two column lines which are adjacent to each other.

12. A liquid crystal display as claimed in claim 9, wherein said two column lines are two column lines of the same color which are adjacent to each other.

13. A liquid crystal display as claimed in claim 9, wherein the connection of said control circuit to the column line at the output end of said first or second column line driving circuit is switched for each horizontal period or for each field period.

14. A liquid crystal display as claimed in claim 1, wherein said first and second column line driving circuits comprise source follower circuits.

15. A liquid crystal display as claimed in claim 1, wherein said first column line driving circuit is for discharging and said second column line driving circuit is for charging.

16. A liquid crystal display as claimed in claim 1, wherein said liquid crystal display is dot-inversion driven.

* * * * *

UNITED STATES PATENT AND TRADEMARK OFFICE

CERTIFICATE OF CORRECTION

PATENT NO. : 6,157,358
DATED : December 5, 2000
INVENTOR(S) : Nakajima et al.

It is certified that error appears in the above-identified patent and that said Letters Patent is hereby corrected as shown below:

Title page,
Item [30], should read;
-- [30] Foreign Application Priority Data
Aug. 29, 1997 [JP] Japan 9-233518 --

Signed and Sealed this

Ninth Day of April, 2002

*Attest:*

*Attesting Officer*

JAMES E. ROGAN
*Director of the United States Patent and Trademark Office*